United States Patent [19]

Popp

[11] Patent Number: 4,778,337

[45] Date of Patent: Oct. 18, 1988

[54] TURBO-ENGINE WITH INNER CASING

[75] Inventor: Joachim Popp, Dachau, Fed. Rep. of Germany

[73] Assignee: MTU Motoren-und Turbinen-Union Munchen GmbH, Fed. Rep. of Germany

[21] Appl. No.: 945,871

[22] PCT Filed: Mar. 12, 1986

[86] PCT No.: PCT/DE86/00100

§ 371 Date: Nov. 14, 1986

§ 102(e) Date: Nov. 14, 1986

[87] PCT Pub. No.: WO86/05546

PCT Pub. Date: Sep. 25, 1986

[30] Foreign Application Priority Data

Mar. 14, 1985 [DE] Fed. Rep. of Germany ..... 3509193

[51] Int. Cl.[4] ..... F01D 1/04

[52] U.S. Cl. ..... 415/134; 415/138; 415/219 R

[58] Field of Search ..... 415/134, 136, 138, 199.4, 415/199.5, 219 R

[56] References Cited

U.S. PATENT DOCUMENTS

| | | | |
|---|---|---|---|
| 3,343,806 | 9/1967 | Bobo et al. | 415/134 |
| 4,019,320 | 4/1977 | Redinger | 60/226 R |
| 4,023,919 | 5/1977 | Patterson | 415/134 |
| 4,101,242 | 7/1978 | Coplin et al. | 415/134 |

FOREIGN PATENT DOCUMENTS

| | | |
|---|---|---|
| 1459676 | 11/1966 | France . |
| 2516980 | 5/1983 | France . |
| 264083 | 12/1949 | Switzerland . |
| 608514 | 10/1948 | United Kingdom . |
| 2111129 | 6/1983 | United Kingdom . |
| 2115487 | 9/1983 | United Kingdom . |

*Primary Examiner*—Larry I. Schwartz

*Attorney, Agent, or Firm*—Roberts, Spiecens & Cohen

[57] ABSTRACT

A turbo-engine constructed to maintain the radial gap between the rotor and casing. The casing of the engine includes an inner casing having shell-shaped parts with centering seats and adjacent parts are secured a given distance apart axially.

Each shell-shaped part comprises a plurality of angular segments which are secured together by fasteners aligned in a plane extending perpendicularly to the axis of rotation of the rotor.

6 Claims, 2 Drawing Sheets

TURBO-ENGINE WITH INNER CASING

BACKGROUND

In the casings of turbo-engines, particularly multi-stage turbo-engines, the adapting of the thermal behavior with the passage of time to that of the rotor so as to maintain the radial gap over rotor blades and stator vanes constant upon a change in load is always a problem. It is known that, in particular, the gap around the rotor blades has a great effect on efficiency, compressor stall and fuel consumption.

In the design of this casing, the following criteria, among others, are to be taken into account, in addition to the above-mentioned behavior:

(a) low weight
(b) simple manufacture=large tolerances in the case in inaccessibility/small tolerances in the case of accessibility
(c) narrow receiving grooves for the feet of the stator vanes
(d) easy assembly
(e) easy disassembly
(f) rotor bladed and screwed with (d) and (e)
(g) provide grazing layers (narrow blade clearance)
(h) easy repair
(i) roundness of the casing during manufacture
(i) continued roundness of the casing in operation
(k) trueness to shape of the casing in axial direction during operation.

The designs known today are generally subdivided into horizontally (or vertically) divided casings and casings consisting of rings. A cup-shaped casing with suspended segments is another known possibility.

The gap control is generally effected (if provided at all) by blowing against the housing above the rotor blades.

Other problems exist in the case of horizontally or vertically divided cases.

The advantages of one construction cannot be carried over in to the other.

In the case or ring casings, the following advantages are obtained:

radial stiffness and thermal inertia of the flanges
simple manufacture
easy assembly and disassembly of the stator vanes
grazing layers in separate supports
repair friendliness
remaining round in operation.

In the case of horizontally divided casings, the following advantages are obtained:

easy assembly and disassembly of the casing
rotor bladed and screwed.

SUMMARY OF THE INVENTION

The invention seeks to obtain, in addition to the optimalizing of the thermal (radial) gap behavior of a turbo-engine, also the combination of the advantages of ring casings and horizontally divided casings.

This object is achieved by the features set forth in the claims.

DETAILED DESCRIPTION OF A PREFERRED EMBODIMENT

Figure 1:
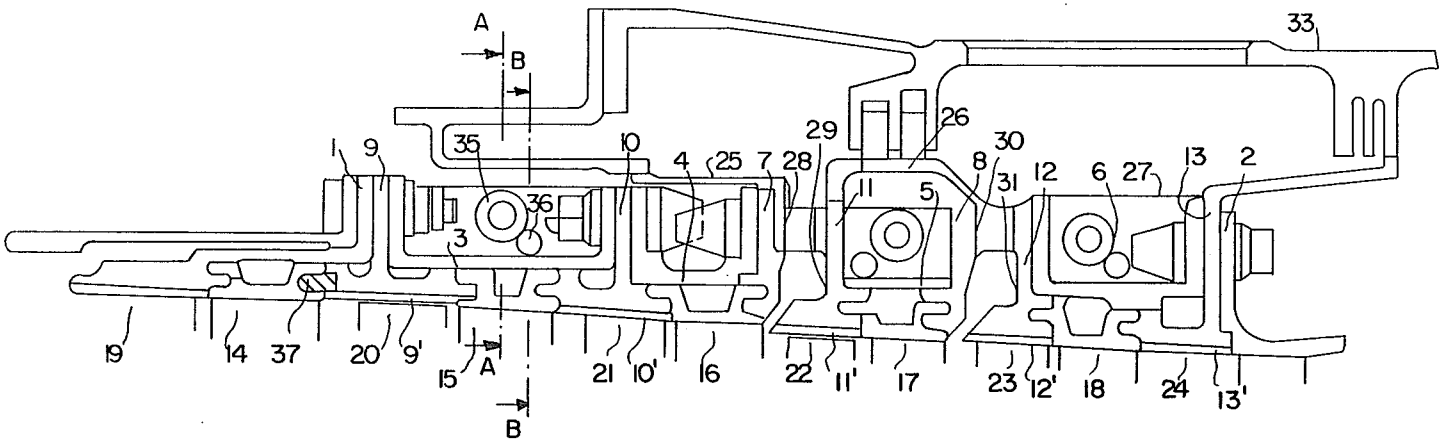
FIG. 1 is an axial sectional view of a turbo-engine casing according to the invention.

The drawing shows, by way of example, a housing structure of a turbo engine with stator vanes therein. The inner casing consists of ring-shaped end casings 1 and 2, horizontally spaced casings 3, 4, 5 and 6, in the form of annular shell elements ring-shaped blow-out casings 7 and 8, and ring-shaped layer supports 9, 10, 11, 12 and 13 with their respective run-in layers 9'; 10'; 11'; 12'; and 13'. The stator vanes are designated 14, 15, 16, 17 and 18 and the rotor blades by 19, 20,21, 22,23 and 24. Furthermore, covers 25, 26, 27 are provided in order to screen off or cover the casings 3-6 5 between the pairs of flanges thereof which determine the thermal behavior, and heat barrier layers 28,29, 20 and 31 may be applied to the covers. The covers 25, 26, 27 are connected to an outer casing 33.

The advantages of the invention over the prior are can be noted from the following:

Thermal behavior:

Optimalized by the arrangement of the rigid flanges of the casings over the rotor vanes in a favorable ratio of radial flange height to length of rotor blade, by the screening elements or covers 25–27 for or casings 3–6 and the heat barrier layers 28–31. The tendency of horizontally divided casings to assume a lemon shape is not transferred to the annular-contour due to these rigid flanges.

Manufacture:

Casing parts have centering seats which serve at the same time to receive the stator vane feet; the casing parts i.e. supports 9–13 which are provided with run-in layers 9'–13' are treated separately; the spray layers are readily accessible on both sides; no deep, inaccessible notches for the reception of the stator vane feet required.

Figure 2:
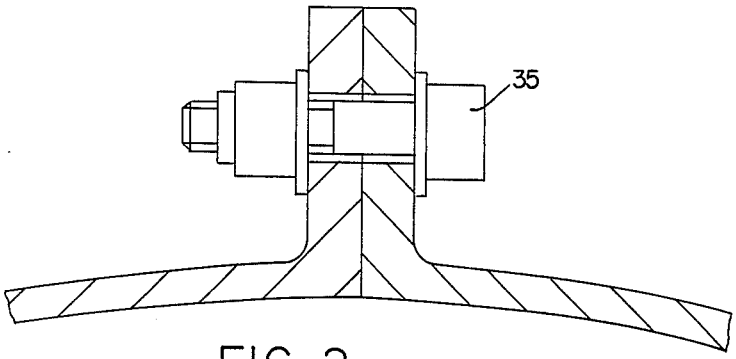
FIG. 2 is a section taken on line A—A in FIG. 1.
Figure 3:
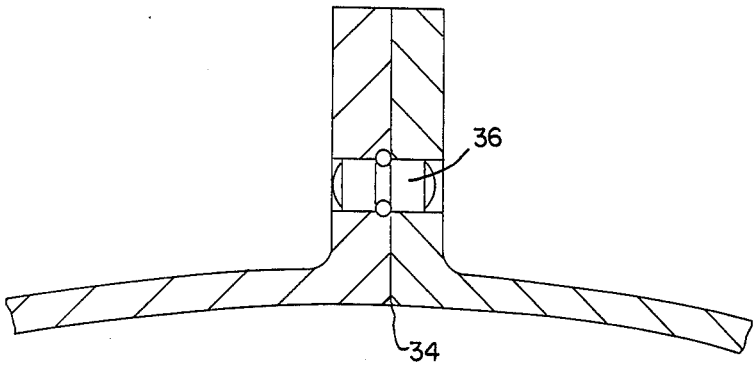
FIG. 3 is a section taken on line B—B in FIG. 1.

Assembly in case of complete rotor:

In the event, for instance, that the parts 1, 14 and 9 have already been assembled, the stator vanes 15 are brought radially inward within the region of section A—A and pushed axially onto the layer support 9. Next, the layer support 10 is pushed into the right-hand hook of the stator vanes 15, in which connection the radial position of these stator vanes can still be checked from the outside. Thereupon, the angular segments of divided casing 3 (see FIGS. 1 and 2) are placed over the layer supports 9 and 10, screwed together radially along dividing joint 34 by bolts 35 and guide pins 36 and then screwed axially to the webs of the layer supports 9 and 10.

Disassembly in the case of a complete rotor:

Effected in the reverse sequence to assembly, in which case the stator vanes 15 can be held from the outside upon the disassembly of the layer support 10.

Grazing or run in layers 9'–13':

The run-in layers are on their own ring-shaped supports 9–13

Repair:

Damage to vanes, see Disassembly; for damage to layers, see Grazing layers.

Roundness during manufacture:

Radial flange height, mass of the layer supports, etc. assure relatively greater roundness of the annular casing as compared with the other designs. Possible lemon shape of the horizontally divided casing is negligible.

Roundness in operation:

Due to diametral centering, substantially better than in the case of bolt centering; rigid, radially high flanges (without scallops) will not be transformed into polygonal shape upon change in load. Possible lemon shape of the horizontally divided casing does not act via the rigid annular casing flanges on the annular space.

Trueness to shape in operation:

Casing parts which are shaped uniformly and strongly in axial direction scarcely have any tendency to deform. Any longitudinal warping between parting-joint flange and casing wall has no effect, in view of the short axial lengths of the parting-joint flanges.

The embodiments shown and described can be modified and individual features combined without thereby going beyond the scope of the invention.

LIST OF REFERENCE NUMBERS

1 End casing, front
2 End casing, rear
3 Connecting casing
4 Connecting casing
5 Connecting casing
6 Connecting casing
7 Blow-out casing
8 Blow-out casing
9 Layer support
10 Layer support
11 Layer support
12 Layer support
13 Layer support
14 Stator vane
15 Stator vane
16 Stator vane
17 Stator vane
18 Stator vane
19 Rotor blade
20 Rotor blade
21 Rotor blade
22 Rotor blade
23 Rotor blade
24 Rotor blade
25 Cover
26 Cover
27 Cover
28 Heat barrier layer
29 Heat barrier layer
30 Heat barrier layer
31 Heat barrier layer
32 Mounting part dimension
33 Outer casing
34 Parting lines
35 Screws
36 Pins
37 Auxiliary ring

I claim:

1. A thermal turbo-engine comprising a rotor which rotates about an axis of rotation and includes a plurality of axially spaced rotor blades, an inner casing including a plurality of axially spaced annular shell elements surrounding the rotor, a plurality of annular supports juxtaposed in alternation between adjacent shell elements, said shell elements and said supports being arranged rotationally symmetrically about said axis of rotation and in coaxial alignment to each other, each support carrying a run-in layer facing a respective rotor blade, means detachably connecting the shell elements and the supports to one another in planes passing transversely through said axis of rotation, said shell elements each including opposite radial flanges, said supports each including a radial web engaged between the flanges of adjacent shell elements, said radial flanges and said webs therebetween being in a position substantially above said rotor blades, a plurality of stator blades between respective adjacent supports, each stator blade including a foot held and supported between adjacent ones of said supports, each of said annular shell elements being divided into a plurality of angular segments having abutting flanges disposed in axial planes passing through the axis of rotation of the rotor, fastening elements aligned in a plane extending essentially perpendicularly to said axis of rotation and detachably connecting said angular segments of each shell element at its said abutting flanges, an outer casing surrounding said shell elements and annular cover rings connecting said shell elements to said outer casing.

2. A thermal turbo-engine as claimed in claim 1 wherein said flanges of adjacent shell elements can be spread apart axially to permit introduction therebetween of said web of the associated support during assembly.

3. A thermal turbo-engine as claimed in claim 1 wherein said supports and adjacent shell elements include interengaging projections and recesses.

4. A thermal turbo-engine as claimed in claim 1 further comprising end casings at opposite ends of the inner casing abutting against endmost of said supports, said end casings being constructed to remain permanently round upon thermal expansion.

5. A thermal turbo-engine as claimed in claim 1 further comprising guide pins between adjacent angular segments of each shell element.

6. A thermal turbo-engine as claimed in claim 1 wherein the feet of the stators and the adjacent supports include interengaging projections and recesses so that said feet are form-locked between the supports when the supports are secured successively to the shell elements.

* * * * *